United States Patent [19]

Tickle

[11] 4,056,171

[45] Nov. 1, 1977

[54] LOW FRICTION SUPPORT FOR DISC BRAKE PAD

[75] Inventor: Colin John Frederick Tickle, Birmingham, England

[73] Assignee: Girling Limited, Birmingham, England

[21] Appl. No.: 693,910

[22] Filed: June 8, 1976

[30] Foreign Application Priority Data

June 9, 1975 United Kingdom ..... 24698/75

[51] Int. Cl.[2] ..... B60T 1/06

[52] U.S. Cl. ..... 188/18 A; 188/74; 188/153 R; 188/205 R

[58] Field of Search ..... 188/18 A, 18 R, 17, 188/74, 75, 76, 153 R, 197, 203, 72.1, 72.4, 70 R, 73.3, 83, 153 D, 153 A, 205, 206

[56] References Cited

U.S. PATENT DOCUMENTS

| | | | |
|---|---|---|---|
| 3,280,945 | 10/1966 | Spalding | 188/153 R X |
| 3,334,708 | 8/1967 | Swift | 188/72.4 |
| 3,557,915 | 1/1971 | Pollinger | 188/153 R X |

FOREIGN PATENT DOCUMENTS

| | | | |
|---|---|---|---|
| 566,823 | 1/1945 | United Kingdom | 188/74 |

*Primary Examiner*—Stephen G. Kunin
*Assistant Examiner*—Douglas C. Butler
*Attorney, Agent, or Firm*—Scrivener, Parker, Scrivener & Clarke

[57] ABSTRACT

A brake comprises an elongate friction pad engageable with a rotor surface, the friction pad being supported close to the rotor surface by a support. A connecting link connects the support to a fixed structure and transmits the braking drag forces to the fixed structure whilst permitting a degree of substantially friction-free movement of the body of friction material toward and away from the rotor surface.

1 Claim, 5 Drawing Figures

LOW FRICTION SUPPORT FOR DISC BRAKE PAD

This invention relates to brakes.

In known brakes in which a friction pad is applied to the surface of a rotor, brake drag forces are transmitted to a fixed structure by pad supports which resist, by friction, pad movement in a direction perpendicular to the rotor surface when the pad is applied to the surface. If the rotor surface has "run out", i.e. if it is distorted or has undulations, the pad is prevented from following the surface movement of the rotor due to the resistance to movement perpendicular to the surface and cyclic variations in the braking forces occur. The high braking forces which are applied to the high spots of the rotor surface may cause extreme over-heating, which is a serious problem. It is often difficult to control the amount of run out of the rotor surface.

It has been previously proposed to overcome the problem of overheating by providing a support system for the pad which comprises a swinging knuckle joint supporting the pad and mounted on a swinging arm; in such a system the pad can follow the run out of the rotor surface with little hysteresis. In such previously proposed brakes the pad thickness is small compared to its other dimensions and to the length of the swinging arms so that the geometry of the system is not significantly altered by wear of the pad. Because of this the pad wears relatively quickly and has to be replaced frequently. If the pad is thick in the direction of wear there are the problems that a new pad forms a long cantilever which is subjected to the drag force, with the result that bending stresses in the friction material may cause failure and the drag force may twist and bend the pad causing uncontrolled taper wear of the pad and consequent increased brake pad clearance. Further the geometry of the system changes significantly with wear of the brake pad, unless the swinging arm is inconveniently long. This not only causes variations in brake torque, but moves the pad out of position relative to the rotor surface.

The present invention provides a brake comprising an elongate body of friction material for braking engagement with a rotor surface, a support close to said rotor surface supporting the body of friction material; connecting means connecting the support to a fixed structure, and means urging the body of friction material into engagement with the rotor surface, wherein said connecting means transmits the drag forces to the fixed structure whilst permitting a degree of substantially friction-free movement of the body of friction material toward and away from the rotor surface.

Thus, the friction member can follow the run out on the rotor surface and the braking force applied to the rotor surface is not substantially altered by the friction material engaging the run out.

In each of the embodiments described in more detail below the support comprises an abutment member carried by a low friction support which transmits the lateral drag force to a frame structure but permits the low friction movement of the friction member perpendicular to the rotor surface. As described below the low friction support may be a resilient plate or a low friction pivot arrangement, but other supports, for example a hydrostatic bearing, a linear low-friction bearing, or a rolling or a rocking bearing, may be used.

Two forms of brake in accordance with the invention will now be described by way of example with reference to the accompanying drawings. In the drawings.

Figure 1:
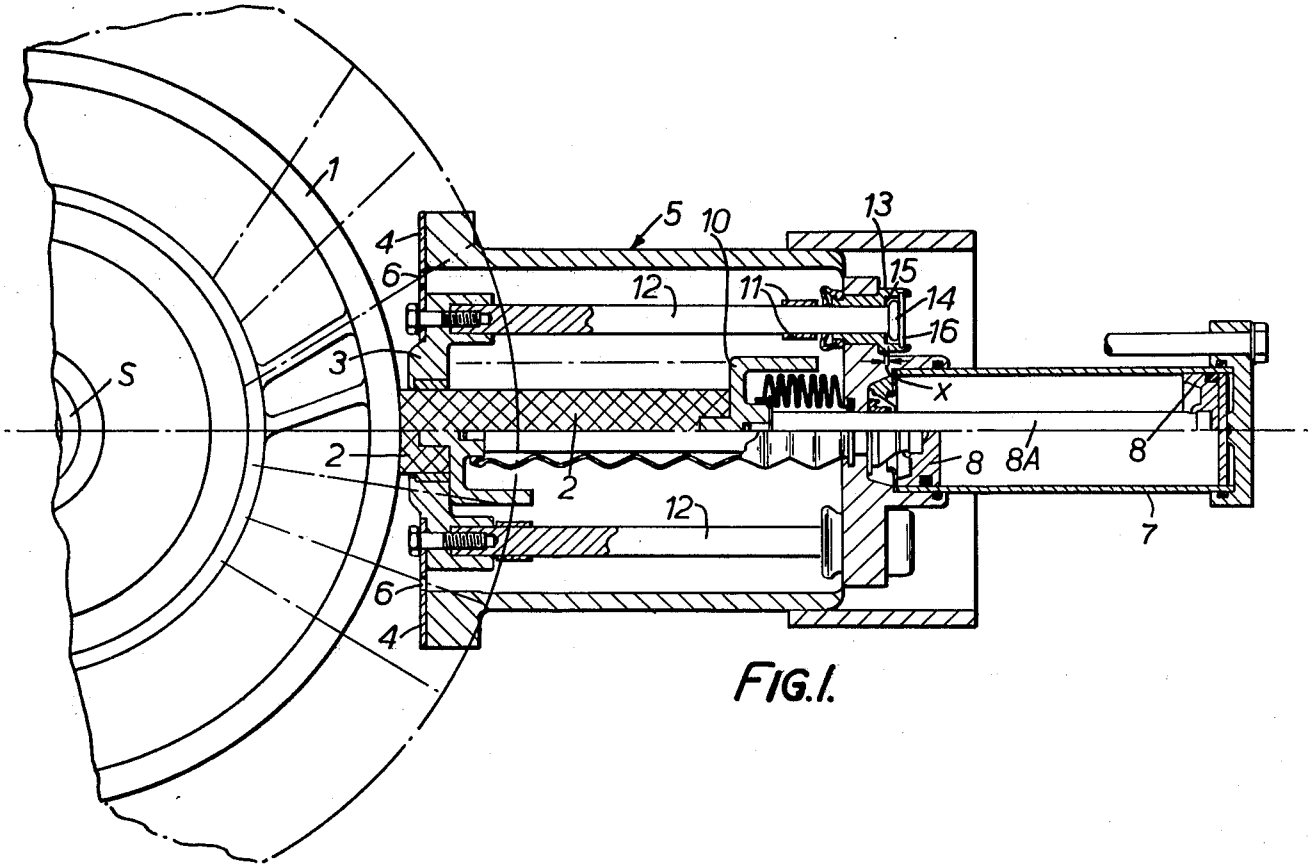
FIG. 1 is a part axial section view of one form of brake showing parts in the relative positions they adopt when a friction member is new and worn respectively.
Figure 2:
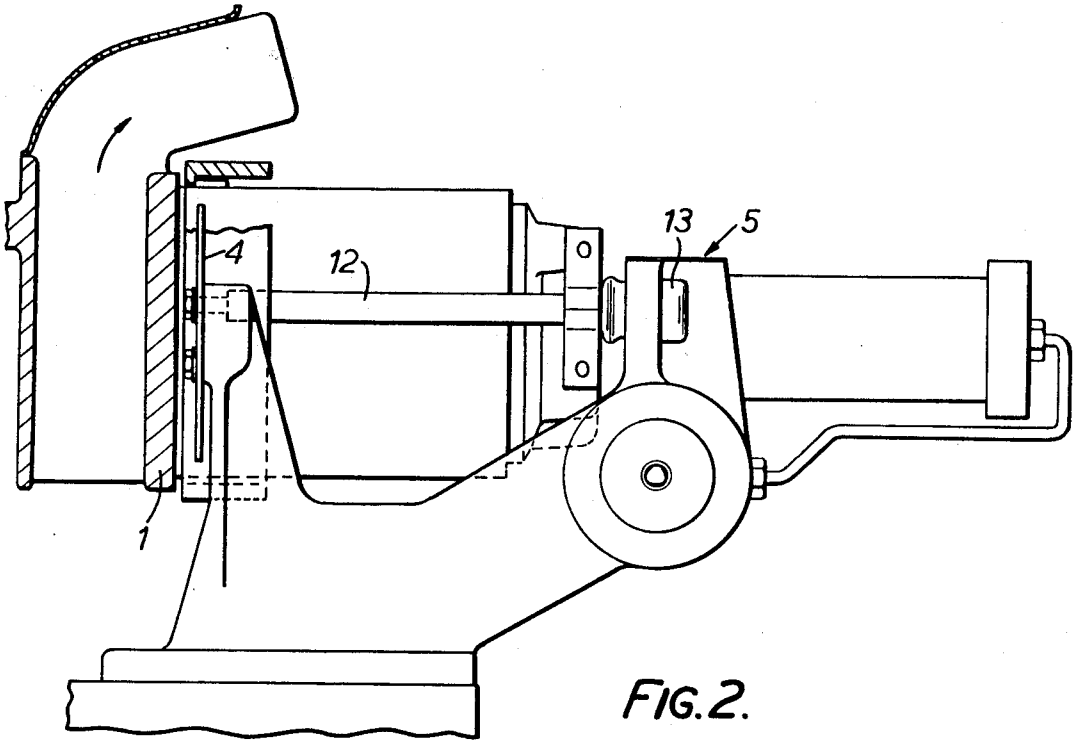
FIG. 2 is a plan view of the brake of FIG. 1.

The brake shown in FIGS. 1 and 2 is arranged to brake a shaft S having a rotor 1, the periphery of the rotor being engageable by an elongate friction pad 2. The upper and lower parts of FIG. 1 show the relative positions of the brake parts with a new pad and a worn pad, respectively.

The forward end of the pad 2 extends through and is supported by an abutment member 3 located close to the peripheral braking surface of the rotor. Flexible plates 4 are attached to respective opposite sides of the abutment member 3 and are secured to the inner ends of a fixed frame structure 5. Each flexible plate has an elongate slot 6 extending along part of its length. Lateral drag forces acting on the friction pad 2 are transmitted through the abutment member 3 in the plane of the flexible plates 4 to the fixed structure 5, while the flexible plates 4 permit a degree of substantially free axial movement of the friction pad 2 in a direction perpendicular to the rotor surface.

The brake is actuated by a fluid-operated motor comprising a piston 8 working in a cylinder 7, the piston carrying a piston rod 8A which is connected at its forward end to a carrier 10. The carrier 10 supports the rear end of the friction pad 2 and transmits the brake applying forces from the piston rod 8A to the friction pad 2. Attached to the carrier 10 are friction plates 11 which are guided on associated rods 12. Each rod 12 is secured at its forward end to the abutment member 3 and extends rearwardly through an associated apertured guide member 13 mounted in the fixed structure 5 and has an enlarged head portion 14 which is retained within a recess 15 in the associated guide member 13 by a disc 16 held in position by peened over ends of the guide member. A small amount of clearance $x$ is provided between the bottom of the recess 15 and the head portion 14 of the rod 12.

In operation, the brake applying force is transmitted from the piston 8 to the carrier 10 which, because of its frictional engagement with rods 12, initially moves the rods to take up the clearance $x$ and moves the abutment member 3 forwardly through that distance. Further movement of the carrier 10 moves the friction pad 2 into engagement with the surface of the rotor 1.

Drag forces on the friction member 2 acting laterally thereof are transmitted to the fixed structure 5, but any "run out" on the rotor surface moves the friction pad in a direction perpendicular to the rotor surface towards and away from the axis of rotation of the rotor. The motion is substantially free since only a small amount of frictional resistance is encountered. The friction pad therefore remains in contact with the rotor surface without substantial changes in the braking effort being applied to the rotor surface by the friction pad, so that variations in the braking effort are obviated, or at least reduced to a minimum.

Although only one friction pad 2 is illustrated, two or more could be used.

Figure 3:
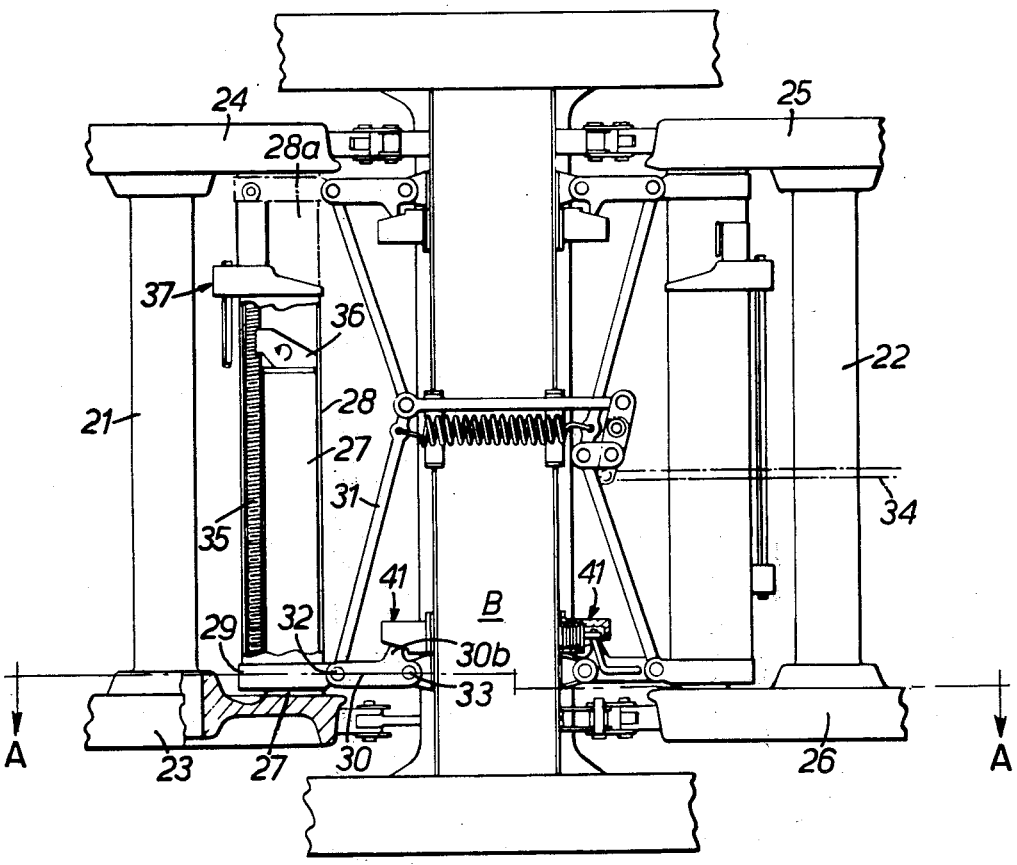
FIG. 3 is a plan view of another form of brake.
Figure 4:
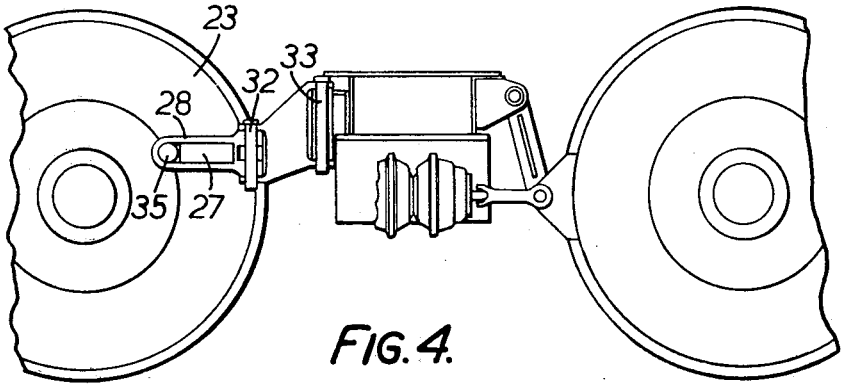
FIG. 4 is a section taken along the line A—A of FIG. 3.
Figure 5:
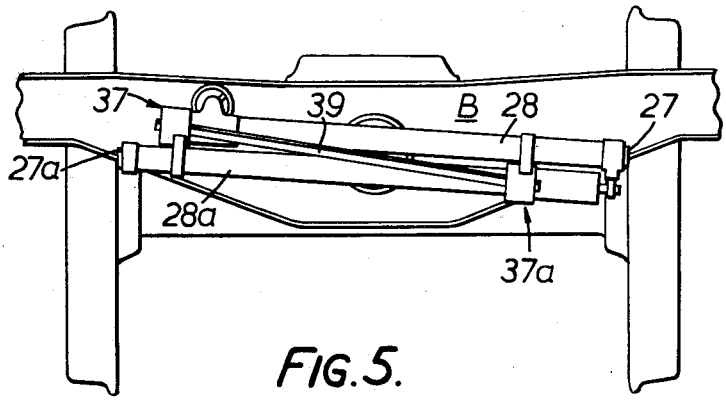
FIG. 5 is a rear elevational view showing part of the brake system of FIG. 3, but with parts removed for the sake of clarity.

The brake system of FIGS. 3 to 5 is arranged to brake the wheels 23 to 26 (FIG. 3) of a railway vehicle, the wheels being supported on axles 21, 22. The brake system is formed in two parts, one for each axle set, which are substantially mirror images of each other and only one part, the part acting on axle 21 will be described in detail below. Each part has two identical brakes, one acting on each wheel. The reference numerals applied to the brakes are the same except that the numerals relating to the device acting on wheel 24 have the suffix *a.*

Referring particularly to braking of wheel 23, an elongate friction pad 27 is enclosed in a tubular guide 28 to one end of which is attached an abutment member 29 located close the braking surface of the wheel 23. An elongate screw member 35 is located in the tube 28 laterally adjacent the friction pad 27 and is engaged by a nut member 36 which has an arcuate portion in screw-threaded engagement with the screw member 35. The nut member 36 also engages with the inner end of the friction pad 27.

The abutment member 29 is pivotally connected by a pivot pin 32 to a swinging arm 30 and to a rod 31 of an operating linkage. The arm 30 is pivoted at its other end to a frame by a pin 33 and has a part 30*b* which engages a self-centering device 41, which need not be described here. The pivot pins 32 and 33 provide low-friction connections. The operating linkage includes an input rod 34 which is pulled to apply the brake, thus applying a compression force to rod 31 which urges the abutment member 29 and tube 28 towards the wheel 23. The brake-applying force is transmitted from the tube 28 through the screw member 35 and nut member 36 to the friction pad 27 to urge the pad into contact with the braking surface of the wheel.

As in the previous embodiment, the abutment member 29 transmits drag forces to a frame structure in the form of bolster B through the link 30, but axial movement of the pad 27 in a direction parallel with the axle 21 and perpendicular to the braking surface of the wheel is permitted due to the arrangement of the connections 32 and 33. Such movement is substantially free because of the low-friction connections.

Adjusting means are provided to effect adjustment of the friction pad relative to the wheel and comprises an adjuster 37 of any suitable type which senses relative movement between tubes 28, 28*a* and if such movement exceeds a predetermined value rotates screw member 35 to effect adjustment. The adjuster 37 preferably has a rotary member non-rotatably mounted on a rod 39, preferably of square-cross section, which transmits rotary motion of the screw member 35 to a secondary adjuster 37*a* connected to the other end of the rod 39, the secondary adjuster serving to adjust the position of the pad 27*a* of the braking device acting on wheel 24.

Although only one friction pad 27 is shown in each tube, more than one pad could be used.

I claim:

1. A brake for braking a rotor having a braking surface, comprising an elongate body of friction material for braking engagement with said rotor surface; a support close to said rotor surface supporting said body of friction material; a fixed structure; connecting means connecting said support to said fixed structure; and means for urging said body of friction material into engagement with said rotor surface, wherein said connecting means comprises at least one flexible member which is relatively rigid in a first plane perpendicular to the direction of movement of said body of friction material and which is flexible in a plane perpendicular to said first plane, said flexible member comprising a plate including means defining an elongate slot which permits said flexing, said member being connected between said support and said fixed structure.

* * * * *